US005083903A

United States Patent [19]

Erdmann

[11] Patent Number: 5,083,903

[45] Date of Patent: Jan. 28, 1992

[54] SHROUD INSERT FOR TURBOMACHINERY BLADE

[75] Inventor: Omer D. Erdmann, Cincinnati, Ohio

[73] Assignee: General Electric Company, Cincinnati, Ohio

[21] Appl. No.: 566,004

[22] Filed: Jul. 31, 1990

[51] Int. Cl.[5] ..... F01D 5/16

[52] U.S. Cl. ..... 416/190; 416/191; 416/224; 416/229 A; 29/889.7

[58] Field of Search ..... 416/190, 191, 194, 195, 416/196 R, 224, 229 R, 229 A, 500; 29/889, 889.7; 415/191, 208.1, 209.2

[56] References Cited

U.S. PATENT DOCUMENTS

| | | | |
|---|---|---|---|
| 3,185,441 | 5/1965 | Reuter | 416/190 |
| 3,327,995 | 6/1967 | Blackhurst et al. | 416/190 |
| 3,576,377 | 4/1971 | Beanland | 416/190 |
| 4,257,741 | 3/1981 | Betts et al. . | |
| 4,589,175 | 5/1986 | Arrigoni | 416/190 |
| 4,948,338 | 8/1990 | Wickerson | 416/190 |

FOREIGN PATENT DOCUMENTS

| | | | |
|---|---|---|---|
| 287371 | 10/1988 | European Pat. Off. | 29/889.7 |
| 94001 | 4/1988 | Japan | 416/196 R |
| 154802 | 6/1988 | Japan | 416/191 |

*Primary Examiner*—Edward K. Look
*Assistant Examiner*—James A. Larson
*Attorney, Agent, or Firm*—Jerome C. Squillaro; James P. Davidson

[57] ABSTRACT

A method and apparatus for forming a hardened contact surface on a shroud of a turbo machinery blade comprising casting the blade and internal shroud with a metal insert into the casting mold so that the blade is cast with the insert in place. The insert may be formed with a projection extending from a wear surface of the shroud into the plane of the blade shroud such that the material from which the blade is made is cast about the projection to firmly and mechanically hold the insert in place. Each insert is preferably formed of a relatively low coefficient of friction and high wear resistant material whereby contact between abutting inserts on adjacent shroud surfaces have a high degree of slippage.

5 Claims, 1 Drawing Sheet

SHROUD INSERT FOR TURBOMACHINERY BLADE

FIELD OF THE INVENTION

This invention relates to turbomachinery blades and, more particularly, to blades having shrouds for dynamic restraint and damping.

BACKGROUND OF THE INVENTION

A variety of turbomachinery such as gas turbine engines utilizes projections such as mid span or tip shrouds or other damping means to reduce vibratory loading on blade airfoils. A principal function of blade shrouds in gas turbine engines is to provide dynamic restraint and damping, a role which subjects the blade-to-blade mating surfaces to significant wear. In order to control this wear, shrouded blades use special materials welded to their mating shroud faces. U.S. Pat. No. 4,257,741 assigned to the assignee of the present invention describes one method and apparatus for welding a tungsten carbide material to a surface which is subject to wear in a gas turbine engine. While the welding process is sufficient to attach a hard wear resistant material to a turbine blade, the process is one which requires extreme care in order to avoid overheating the turbine blade at the point of attachment resulting in weakening of the material or in generating cracks which may lead to subsequent failure. Thus, it is desirable to provide a method for attaching a hardened insert to a blade shroud in a manner which does not require the extreme care necessary to generate a hardened surface by welding.

SUMMARY OF THE INVENTION

It is an object of the present invention to provide an improved method and apparatus for securing a wear surface to an edge of a blade shroud.

The above and other objects are attained in one form by forming a hardened metal insert and thereafter casting the blade with the metal insert in the mold so that the blade is cast with the insert in place. The insert is positioned in the mold so that is has a contact surface oriented to mate with a corresponding surface of an adjacent blade when the blades are inserted in the turbomachinery. In one form, each insert is provided with a projection extending from a wear surface and into the plane of the blade shroud so that the material of which the blade is made is cast about the projection to firmly and mechanically hold the insert in the blade. Preferably, each insert is formed of a relatively low coefficient of friction and high wear resistance, such as, for example, a material containing a relatively large percentage of molybdenum whereby contact between abutting inserts on adjacent shroud surfaces has a degree of slippage.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
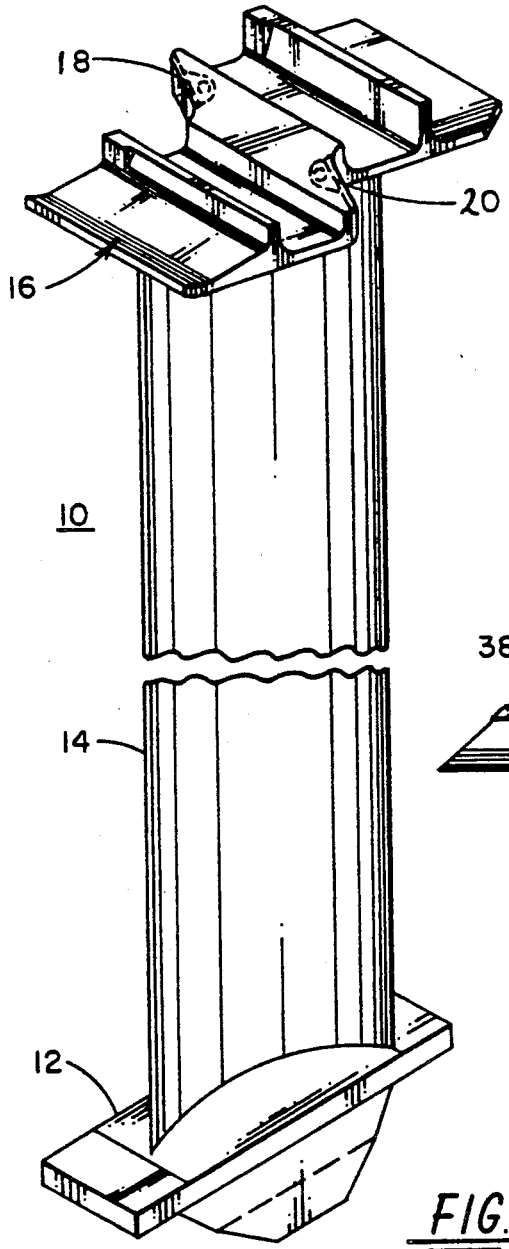
FIG. 1 is a perspective view of a turbomachinery blade having a tip shroud with wear surfaces formed in accordance with the present invention.

Turning first to FIG. 1, there is shown a perspective view of a turbomachinery blade 10 of a type utilized in a gas turbine engine. The blade 10 has a root platform 12, an airfoil section 14, and a tip shroud 16. The blade tip shroud 16 has opposite Z-shaped edges which provide oppositely directed wear surfaces 18 and 20. The wear surface 18 is positioned to mate with a corresponding wear surface 20 on an adjacent blade and the wear surface 20 of the blade 10 is arranged to mate with a wear surface 18 on an adjacent blade. Each of these wear surfaces is formed with a hardened metal alloy to withstand the wear caused by vibrations of the blades and to prevent the blades from being damaged by contact between adjacent blades. In the prior art, these wear surfaces had been hardened metal accretions which were welded to the shroud surfaces. However, as previously mentioned, the technique of welding hardened metal to the high temperature metal of which the blade is formed requires extreme care to prevent damage to the blade material either from heat causing loss of blade properties or creating cracks in the tip shroud surface.

Figure 2:
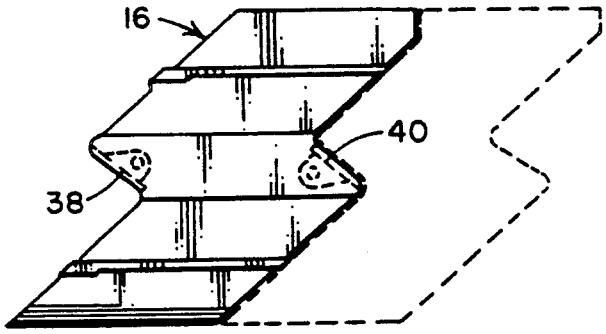
FIG. 2 is a plan view of the shroud of FIG. 1 showing the location of the inserts.
Figure 3A:
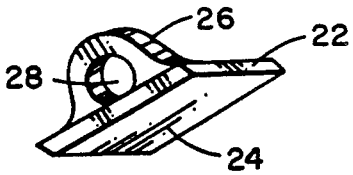
FIGS. 3A, 3B, and 3C are perspective, side, and edge views of one form of an insert suitable for use with the present invention.
Figure 3B:
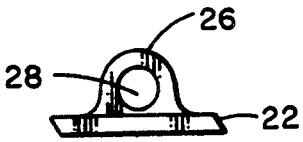
Figure 3C:
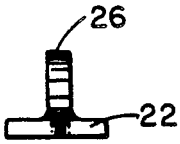

A plan view of the blade shroud 16 and inserts 38 and 40 is shown in FIG. 2. In this view, the extent of the inserts 38 and 40 which can form the wear surfaces 18 and 20 can clearly be seen. It will be appreciated that the inserts 38, 40 are not normally visible in a plan view but that for purposes of illustration, the material of the shroud 16 overlaying the inserts may be considered either transparent or cutaway in order to show the insert location. Before continuing with the description of FIG. 2, reference is now made to FIGS. 3A–3C in which there is shown one embodiment of an insert suitable for use for the inserts 38 and 40. Considering these three figures, it can be seen that the insert comprises a bearing member 22 having a substantially flat wear surface 24 with a mounting member 26 projecting from a rear portion of the bearing member. The mounting member preferably includes a through aperture 28 which is filled by the casting material of the blade shroud 16 when the insert is cast in situ in the blade shroud. Since the casting material extends through the aperture in the insert, the aperture becomes mechanically attached to the blade shroud to assure that it will not work loose from vibration and constant hammering if the bond between the insert and the casting material is loosened. Other forms of mounting members could be utilized for the insert and, if the bond between the material of the shroud and that of the insert can be made sufficiently strong, the mounting member 26 could be eliminated.

Referring again to FIG. 2, it can be seen that the inserts 38, 40 are each cast into the blade shroud 16 such that the bearing surface 24 is oriented to mate with a similar bearing surface on an adjacent blade shroud. The mounting members 26 extend into the cast material of the shroud and bond the inserts to the shroud.

The insert 38 or 40 is preferably formed of a material which resists wear and has some degree of lubricity. One such material common to the industry is Tribaloy 800 TM. These characteristics are important to prevent the abutting inserts and adjacent blades from sticking while at the same time reducing the degree of wear by allowing the mating inserts to slide one against the other.

In the method of forming a turbomachinery blade in accordance with the present invention, a wax pattern is first prepared suitable for casting the blade. The inserts are positioned in this pattern in their desired orientation. A ceramic mold is formed around this pattern and when it is fired, the wax melts away leaving the inserts positioned in the mold. The casting material is then poured into the mold. The casting material surrounds the insert filling up the voids in the form and is allowed to set. Once the casting material is set, the blade with the in situ inserts cast in place is then ready for final machining in preparation for use. Depending upon the accuracy with which the inserts 38, 40 are oriented during the casting process or upon the finish of surface 24, it may be necessary to machine finish the bearing surface 24 to assure the required angular orientation or smoothness of the wear surfaces 18, 20. For example, the surfaces 18 and 20 are substantially parallel and each blade shroud must be substantially identical to provide proper fit when the blade are arranged in their assembled configuration.

While the invention has been described in what is presently considered to be a preferred embodiment, other modifications and variations will become apparent to those skilled in the art. It is intended therefore that the invention not be limited to the specific embodiment but be interpreted within the full spirit and scope of the appended claims.

What is claimed is:

1. A turbomachinery blade including an airfoil and a shroud, the shroud having a pair of wear surfaces on opposite edges thereof, each wear surface comprising a cast in situ insert having an outer planar portion, one surface of said outer planar portion constitutes said wear surface, and a projection extending from a surface opposite said wear surface into said shroud whereby said insert is held in place by casting material of said shroud.

2. The turbomachinery blade of claim 1 wherein said insert is formed of a hardened alloy which inhibits wear and provides some degree of lubricity.

3. A method for applying a wear resistant surface to a turbomachinery blade, the blade having a shroud with a contact surface adapted to mate with a corresponding surface on an adjacent blade, the shroud providing dynamic restraint and damping to the associated blade by contact with shrouds of such adjacent blades, the method comprising the step of casting an insert into each contact surface of a blade shroud during casting of the blade.

4. The method of claim 3 and including the further step of machining each insert after casting in the blade shroud to form substantially parallel insert surfaces.

5. The method of claim 3 wherein the insert comprises a substantially flat wear surface and a mounting member extending from a rear portion thereof, said mounting member extending into the cast blade shroud whereby the insert is mechanically coupled to the shroud.

* * * * *